US005808648A

United States Patent [19]

Kubota et al.

[11] Patent Number: 5,808,648

[45] Date of Patent: Sep. 15, 1998

[54] IMAGE FORMING APPARATUS AND IMAGE FORMING METHOD USING PYROELECTRIC IMAGING LAYER

[75] Inventors: Hiroshi Kubota; Takahiro Horiuchi, both of Yamatotakada, Japan

[73] Assignee: Sharp Kabushiki Kaisha, Osaka, Japan

[21] Appl. No.: 818,076

[22] Filed: Mar. 14, 1997

[30] Foreign Application Priority Data

Mar. 19, 1996 [JP] Japan ..... 8-063518

[51] Int. Cl.[6] ..... G03G 15/00

[52] U.S. Cl. ..... 347/114; 347/141; 399/154; 430/350

[58] Field of Search ..... 399/136, 154; 347/141, 149, 153, 154, 112, 114; 430/48, 56, 130, 350, 330

[56] References Cited

U.S. PATENT DOCUMENTS

| | | | |
|---|---|---|---|
| 3,713,822 | 1/1973 | Kless . | |
| 3,935,327 | 1/1976 | Taylor . | |
| 5,153,615 | 10/1992 | Snelling . | |
| 5,185,619 | 2/1993 | Snelling . | |
| 5,216,466 | 6/1993 | Mitani | 399/154 |
| 5,580,688 | 12/1996 | Hirt . | |
| 5,604,569 | 2/1997 | Kubota | 399/232 |
| 5,660,486 | 8/1997 | Okuda et al. . | |

OTHER PUBLICATIONS

O. Masaharu, et al. "Image Forming Device", Japanese Laid–Open Patent Publication No. 3–212658, Laid Open on Sep. 18, 1991.

O. Taizo, et al. "Developing Device", Japanese Laid–Open Patent Publication No. 59–172663, Laid Open on Sep. 29, 1984.

D. Seiki, et al. "Piezoelectric Element", Japanese Laid–Open Patent Publication No. 5–259525, Laid Open on Oct. 8, 1993.

*Primary Examiner*—Robert Beatty

*Attorney, Agent, or Firm*—David G. Conlin; William J. Daley, Jr.

[57] ABSTRACT

An image forming apparatus forms an electrostatic latent image on a latent image forming body having a dielectric material layer on its surface when a write electrode comes into contact with the dielectric material layer. The image forming apparatus develops the electrostatic latent image with a charged developer, and transfers a visual image thus obtained onto recording paper. The dielectric material layer is composed of a PZT (lead titanate zirconate) which is formed through crystal growth by the hydrothermal method. The dielectric material layer has a high relative dielectric constant and exhibits the pyroelectric effect. Furthermore, since the dielectric material layer is composed of the PZT which is formed through crystal growth by the hydrothermal method, the dielectric material layer can be formed without a heat treatment at a high temperature. Therefore, it is possible to provide, at a low cost, the image forming apparatus having the latent image forming body with which the development of an image at a high recording density is enabled at a low-level power consumption.

18 Claims, 8 Drawing Sheets

IMAGE FORMING APPARATUS AND IMAGE FORMING METHOD USING PYROELECTRIC IMAGING LAYER

FIELD OF THE INVENTION

The present invention relates to an image forming apparatus which forms an image by forming a latent image and developing the same, such as a printer, a copying machine, a word processor, or a facsimile machine.

BACKGROUND OF THE INVENTION

Various image forming processes have been applied to image forming apparatuses such as printers.

For example, as illustrated in FIG. 10, an electrostatic latent image is formed on a latent image forming body 50 having a dielectric material layer 51 on the surface by electrically writing information thereto with the use of a multi-stylus electrode 52. The latent image thus formed is developed with charged recording material particles 53, and the image thus developed is transferred onto a recording medium 54 such as paper. This method has been known since before and are described in a great number of publications.

Known an image forming apparatus as an image forming apparatus incorporating a latent image forming body having a dielectric material layer is, or example, an image forming apparatus having a latent image forming body over whose surface zinc oxide is sprayed, as disclosed in the Japanese Publication for Laid-Open Patent Application No. 59-172663/1984 (Tokukaisho 59-172663).

However, such a conventional image forming apparatus has a problem that development takes time and a recording density obtained is low, since in the image forming apparatus an amount of charge accumulated in the dielectric material layer during the electrostatic latent image forming step is small.

SUMMARY OF THE INVENTION

The object of the present invention is to provide an image forming apparatus which is capable of development at a high development speed and at a high density, and to provide a method for forming images by the use of the above-described image forming apparatus.

To achieve the above object, an image forming apparatus of the present invention is characterized in comprising (1) a latent image forming body having a dielectric material layer on a surface thereof, the dielectric material layer being composed of a lead titanate zirconate (PZT) film formed through crystal growth by the hydrothermal method, (2) a write head for forming an electrostatic latent image by conducting writing with respect to the latent image forming body in accordance with a print pattern, (3) a development vessel for developing the electrostatic latent image with the use of charged developer, and (4) an endothermic device for transferring a visual image obtained by the development means to a recording medium.

According to the above-described arrangement, in a region where the dielectric material layer, which is composed of the PZT film formed on the surface of the latent image forming body, and the write head come into contact, writing in accordance with a print pattern, for example, is carried out with respect to the dielectric material layer by the write head.

By doing so, surface charge is generated in the dielectric material layer and an electrostatic latent image is formed on the latent image forming body in accordance with the print pattern. The surface charge has an effect of attracting the charged developer in the development process. As a result, the charged developer is adsorbed onto the surface of the latent image forming body, thereby developing the electrostatic latent image on the surface of the latent image forming body. Then, a visual image (developer image) thus obtained by the development is transferred onto the recording medium and recorded thereon when heat is applied thereto by, for example, a heating device.

Here, in the present invention, the dielectric material layer is composed of the PZT film which is formed through crystal growth by the hydrothermal method. The PZT film formed through crystal growth by the hydrothermal method has a uniform polarization direction. Therefore, the PZT film formed through crystal growth by the hydrothermal method has excellent pyroelectric characteristics, and hence the transfer can be carried out due to repulsion caused by a pyroelectric effect of the PZT film. As a result, the writing of information and the transfer can be efficiently carried out. The PZT film has a relative dielectric constant $\epsilon_r$ of 300 to 1000, which is greater than that of, for example, zinc oxide used in the conventional arrangement in the order of 100 times. Therefore, by using as the dielectric material layer the PZT film formed through crystal growth by the hydrothermal method, the dielectric material layer has a considerably great amount of surface charge. Accordingly, in the case where writing is carried out with the same voltage, an amount of accumulated charge in this case is greater than that in the case with zinc oxide in the conventional arrangement in the order of 100 times, there by enabling to achieve a higher development speed in the development process using a charged developer, while ensuring a higher recording density.

Furthermore, in the present invention, the dielectric material layer composed of the PZT film is formed through crystal growth by the hydrothermal method. As to the hydrothermal method, a film forming method whereby crystal is grown at a comparatively lower temperature of, for example, 120° C. to 200° C. and at a low atmospheric pressure of, for example, 5 atm, is applied. Therefore, it is possible to form a film on a surface having a large size or a three-dimensional curved surface with a lower cost.

Therefore, in the formation of the dielectric material layer composed of the PZT film having a high relative dielectric constant, a heat treatment at a high temperature is not applied, and a vacuum chamber having a great capacity is not required.

As a result, it is possible to provide, at a low cost, an image forming apparatus which is capable of development at a high speed and at a high density.

To achieve the object described earlier, an image forming method of the present invention for forming images with the use of an image forming apparatus which includes a latent image forming body having a PZT film formed on a surface of the same through crystal growth by the hydrothermal method, a development vessel, a write head provided on an upstream side with respect to the development vessel, and a heating device provided inside the latent image forming body, the method comprising the steps of (a) forming an electrostatic latent image on the latent image forming body in accordance with a print pattern, by causing the write head to get into contact with the latent image forming body in a state where the PZT film is in contact with the development vessel, (b) developing the electrostatic latent image, by causing the development vessel to supply charged developer so that the developer is adsorbed to the surface of the latent image forming body, and (c) transferring a visual image obtained through the development in the step (b) onto a recording medium, by causing repulsion of the developer due to a pyroelectric effect of the PZT film which is caused by heating the latent image forming body with the use of the heating device.

According to the above-described method, charge (surface charge) is generated in the PZT film on the surface of the latent image forming body by causing the write head to get into contact with the latent image forming body in a state where the PZT film is in contact with the development vessel, and as a result the electrostatic latent image is formed on the latent image forming body in accordance with the print pattern.

The PZT film has a relative dielectric constant $\epsilon_r$ of, for example, 300 to 1000, which is greater than that of, for example, zinc oxide used in the conventional arrangement, in the order of nearly 100 times. Therefore, in the case where writing is carried out with the same voltage, an amount of accumulated charge in this case is greater than that in the case with zinc oxide in the conventional arrangement in the order of approximately 100 times. The surface charge generated in the dielectric material layer has an effect of attracting the charged developer in the development process. Therefore, by the above-described image forming method, a higher development speed can be achieved while a higher recording density can be obtained in the development process using a charged developer.

Furthermore, since the PZT film is formed through crystal growth by the hydrothermal method, the PZT film has a uniform polarization direction, and has excellent pyroelectric characteristics. Therefore, by the use of the PZT film, the transfer can be carried out due to repulsion of the developer caused by a pyroelectric effect of the PZT film. As a result, by the aforementioned method, the efficiency of the transfer onto the recording medium is enhanced, while lower power consumption can be achieved. In other words, by the present invention, it is possible to provide an image forming method whereby development at a high speed and at a high temperature can be realized and the transfer efficiency is enhanced.

Furthermore, to achieve the object described earlier, an image forming method of the present invention for forming images with the use of an image forming apparatus which includes a latent image forming body, development vessel, a writing head provided on an upstream side with respect to the development vessel, a heating device provided inside the latent image forming body, and an information light provided inside the writing head, the latent image forming body having a PZT film formed on a surface of the same through crystal growth by the hydrothermal method and an electrode layer under the PZT film, the writing head having a transparent base, a transparent electrode layer and a photoconductive layer, which are provided in this order from the side of the information light, the method comprising the steps of (a) generating conductive carriers on the photoconductive layer by causing the writing head to get into contact with the PZT film in a state where the PZT film is in contact with the development vessel while projecting the information light from the information light source to a region of the contact, (b) forming an electrostatic latent image on the latent image forming body by applying a voltage to the transparent electrode layer while causing the electrode layer of the latent image forming body to have a ground potential so that the PZT film is charged, (c) developing the electrostatic latent image by causing the development vessel to supply charged developer so that the developer is adsorbed to the surface of the latent image forming body, and (d) transferring a visual image obtained through the development in the step (c) onto a recording medium by causing repulsion of the developer due to a pyroelectric effect of the PZT film which is caused by heating the latent image forming body with the use of the heating device.

According to the above-described method, the conductive carriers are generated on the surface of the photoconductive layer by projecting the information light from the information light source to a region where the write head having the information light source inside comes into contact with the dielectric material layer composed of the PZT film on the surface of the latent image forming body. Then, by applying a voltage to the transparent electrode layer while causing the electrode layer of the latent image forming body to have a ground potential, the PZT film is charged. By doing so, the writing in accordance with the print pattern is carried out with respect to the dielectric material layer, thereby causing an electrostatic latent image in accordance with the print pattern to be formed on the latent image forming body. The latent image is developed with the charged developer, and for example, heated by a transfer device, so that the developed image is transferred onto the recording medium and recorded.

The PZT film has a relative dielectric constant $\epsilon_r$ of, for example, 300 to 1000, which is greater than that in the case with, for example, zinc oxide used in the conventional arrangement, in the order of 100 times. Therefore, in the case where writing is carried out with the same voltage, an amount of accumulated charge in this case is greater than that in the case with zinc oxide in the conventional arrangement in the order of about 100 times. The surface charge thus generated in the dielectric material layer has an effect of attracting the charged developer in the development process. Therefore, by the above-described image forming method, a higher development speed can be achieved in the development process using charged developer, while a higher recording density can be obtained.

Furthermore, since the PZT film is formed through crystal growth by the hydrothermal method, the PZT film has a uniform polarization direction, and has excellent pyroelectric characteristics. Therefore, by using the above-described PZT film, the transfer can be carried out due to repulsion caused by a pyroelectric effect of the PZT film. As a result, by the aforementioned method, the efficiency of the transfer onto the recording medium is enhanced, while lower power consumption can be achieved.

Besides, by the foregoing method, the contact movement of the write head and the latent image forming body is not slide but rotational contact. Therefore, abrasion of the write head is drastically lessened, thereby allowing the write head to be long-lived.

Furthermore, by the foregoing method, it is possible to provide an image forming method whereby the development can be carried out at a high development speed at a high temperature, and the transfer can be carried out efficiently.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a cross-sectional view illustrating a structure of a part of a latent image forming body for the use in the printer illustrated in FIG. 1(*a*).

FIG. 3(*b*) is a view illustrating a state where the crystalline nucleuses are grown, in the process for forming the PZT film as the dielectric material layer for the use in the latent image forming body by the hydrothermal method.

FIG. 4(*b*) is a bottom view illustrating a structure of the write electrode for the use in the foregoing printer.

FIG. 6(*b*) is a perspective view illustrating a structure of a development vessel for the use in the foregoing printer.

DESCRIPTION OF THE PREFERRED EMBODIMENTS

[First Embodiment]

Figure 1:
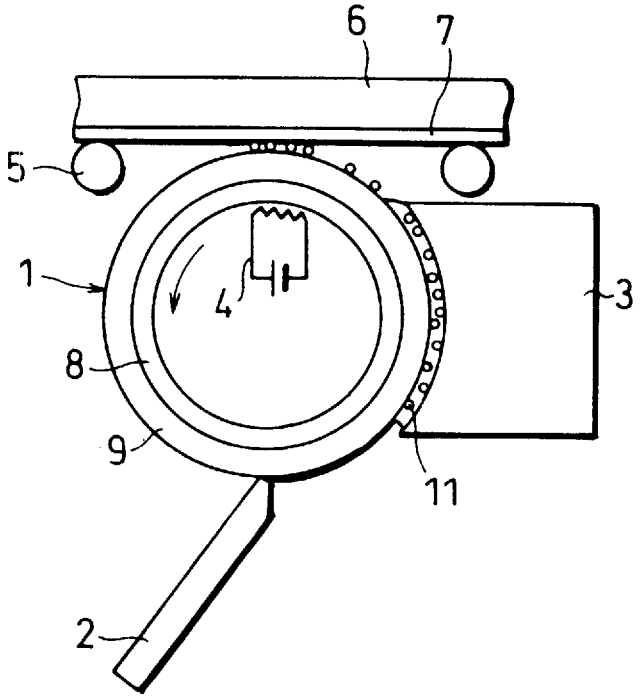
FIG. 1(*a*) is a view illustrating a schematic arrangement of a printer as an example of an image forming apparatus of the present invention.
Figure 1:
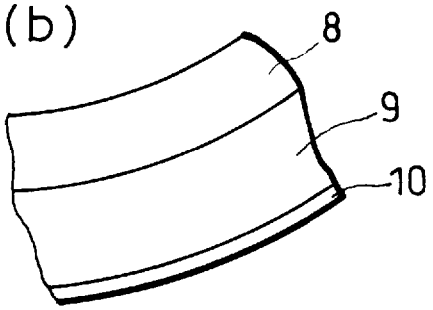

The following description will discuss an embodiment of the present invention, while referring to FIGS. 1(*a*) through 7. Note that an image forming method applied to the present embodiment is commonly applicable to various information apparatuses including a printer, a copying machine, a word processor, and a facsimile machine, as an image forming machine utilizing a latent image forming body, but the following description will specifically discuss a case where the method is applied to a printer.

A printer of the present embodiment has, as major components, a latent image forming body 1, a write electrode 2 (image writing means), a development vessel 3 (development means), and a heating device 4 (heating means), as illustrated in FIG. 1(*a*).

The latent image forming body 1 is a rotatable cylindrical drum. The write electrode 2 constitutes a write head (image writing means) which is provided in contact with the latent image forming body 1 and forms an electrostatic latent image on the latent image forming body 1 by writing information thereto in accordance with a print pattern. The development vessel 3 is development means which develops the electrostatic latent image by supplying liquid developer 11 as developer to the latent image forming body 1 so that the liquid developer 11 is adsorbed thereto. The development vessel 3 is provided on the rotational direction side of the image forming body 1 with respect to the write head. The heating device 4 is heating means provided inside the latent image forming body 1. It also functions as transfer means which, by applying heat, transfers a visual image (developer image) obtained by the development vessel 3 onto paper 7 as a recording medium which has been transported thereto along a backboard 6 by a transport roller 5.

Note that the printer has other members such as a member (not shown) for scratching off waste developer remaining on a surface of the latent image forming body 1, for example, a cleaning blade (not shown).

Besides, although the latent image forming body 1 is a cylindrical drum in the present embodiment, it is not necessarily provided as a cylindrical drum, and it may be formed into, for example, a belt shape.

The latent image forming body 1 is composed of (1) a cylindrical base 8, which is provided as a cylindrical base made of transparent resin, transparent glass, or other materials, and (2) a dielectric material layer 9 composed of a film made of dielectric material, which is provided on a surface of the cylindrical base 8.

The dielectric film layer 9 is made of pyroelectric material having a high relative dielectric constant causing a pyroelectric effect, so that the write and the transfer are efficiently carried out.

To be more specific, a high relative dielectric constant causes a surface electric potential to become greater. Therefore, in the case where a writing operation is carried out with respect to dielectric material layers 9 having different relative dielectric constants, an amount of electric charge accumulated in the dielectric material layer 9 having the higher relative dielectric constant is greater than that accumulated in the dielectric material layer 9 having the lower relative dielectric constant. Therefore, in this case, in the developing process wherein a charged developer is utilized, a higher developing speed and a higher recording density can be achieved by utilizing a dielectric material layer 9 having a high relative dielectric constant.

Figure 2:
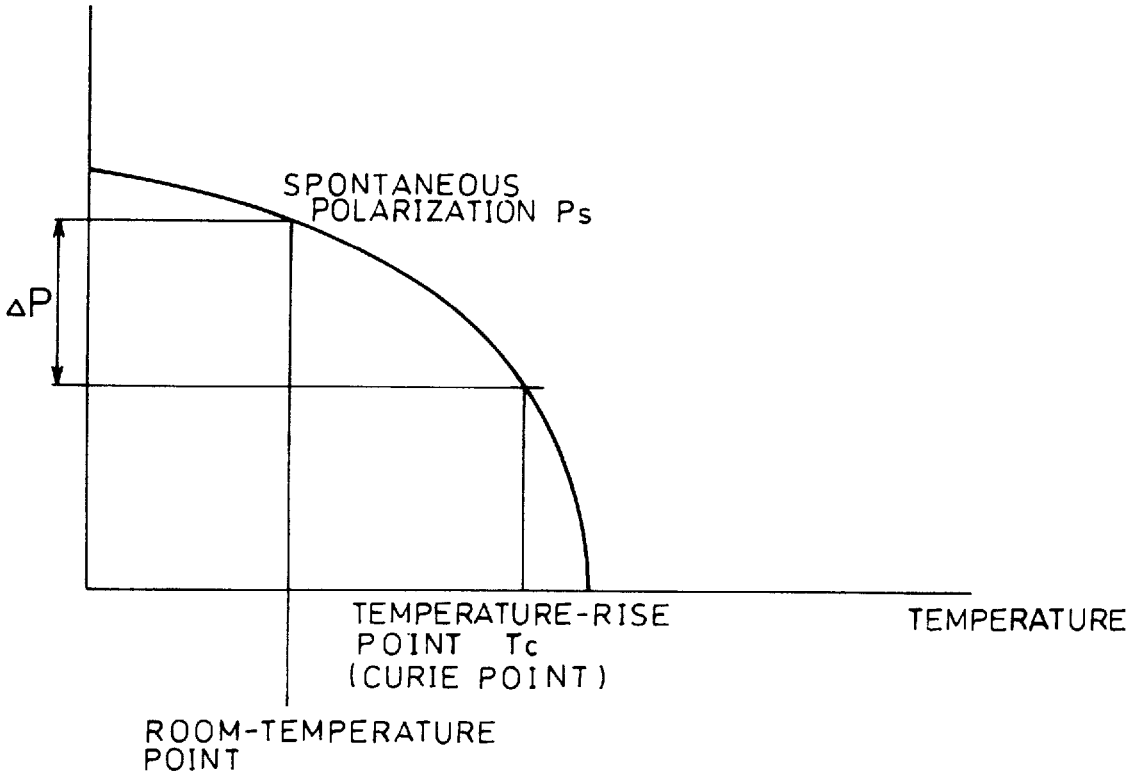
FIG. 2 is a graph illustrating a characteristic of spontaneous polarization of a dielectric material layer for the use in the latent image forming body of the printer shown in FIG. 1(*a*).

Additionally, as illustrated in FIG. 2, the pyroelectric effect exerts a phenomenon wherein the magnitude of polarization of the dielectric material varies with temperatures and a variation $\Delta P$ between a spontaneous polarization value Ps at a room-temperature point and a polarization value at a temperature-rise point upon receipt of a temperature rise is observed as a surface electric potential. Here, the spontaneous polarization is referred to as a state where polarization occurs in the material itself without being affected by an external electric field, that is, a state where the center of positive and negative charges is offset. Normally, the spontaneous polarization is neutralized by charge that is attracted onto the surface of the dielectric material layer 9. When the magnitude of the spontaneous polarization is varied by a temperature change, a difference between the positive and negative charges appears as surface charge.

As for the conditions of the pyroelectric material that is capable of generating a necessary and sufficient quantity of charge so as to cause efficient transfer, it is necessary for the pyroelectric material to have a great spontaneous polarization value Ps at room temperature and also to have a Curie point Tc which is allowed to vary within a certain temperature range. It is preferable that the Curie point Tc falls, for example, within a range from not less than 100° C. to not more than 200° C. The reason is as follows. (1) If the Curie point Tc is too low, the function of the apparatus will become too sensitive to change in the operating environment, and (2) if a material whose Curie point Tc is, for example, lower than 100° C. is used, it will only provide a temperature difference from room temperature in the order of at most 70 deg. Moreover, (3) the pyroelectric material, once subjected to a temperature rise to not lower than its Curie point Tc, loses its spontaneous polarization, and is rendered to a state where its spontaneous polarization is not recovered even after having a temperature drop.

In contrast, if the Curie point Tc is too high, a greater input energy is required, causing adverse effects, such as degradation in thermal response and deterioration in material quality. In the case of material whose Curie point exceeds 200° C., the efficiency in generating charge tends to be lowered since a pyroelectric coefficient is rather small in the vicinity of room temperature, although such a material provides a sufficient difference from room temperature. Therefore, such a material whose Curie point Tc is not lower than 100° C. and also is not higher than 200° C. is preferably selected for forming the dielectric material layer 9.

Figure 3:
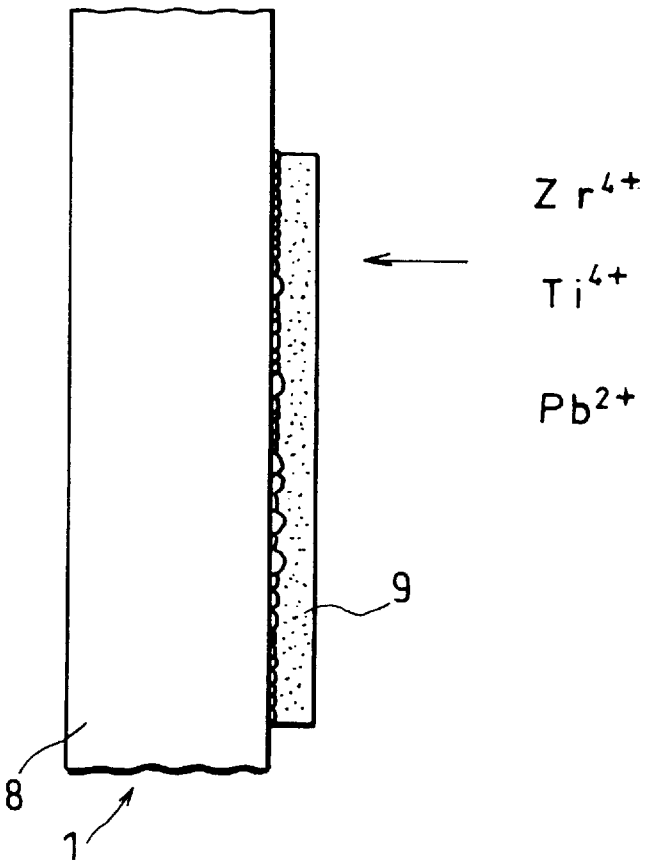
FIG. 3(*a*) is a view illustrating a state where crystalline nucleuses of PZT are formed on a surface of a cylindrical base, in a process for forming a PZT film as the dielectric material layer for the use in the latent image forming body by the hydrothermal method.
Figure 3:
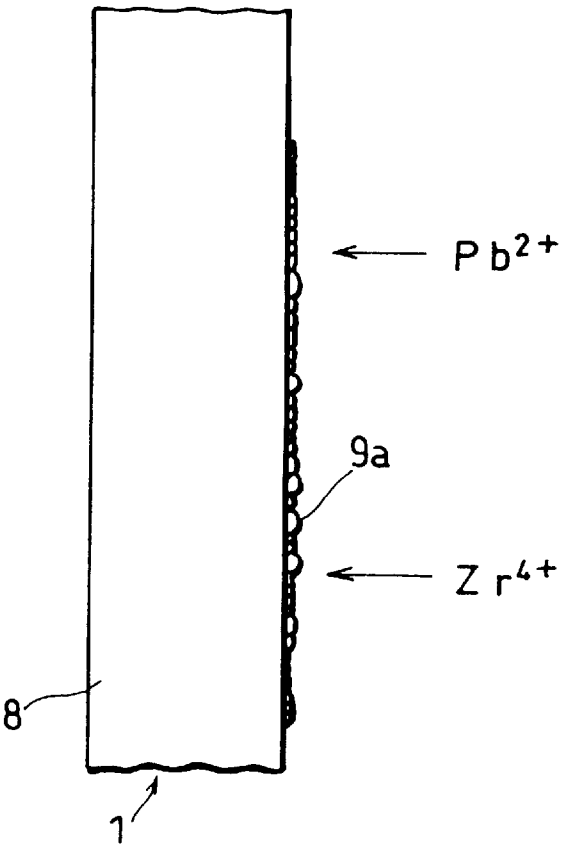

More specifically, the dielectric material layer 9 is a film which is made of lead titanate zirconate (PZT) through a process shown in FIGS. 3(*a*) and 3(*b*) by the hydrothermal method, so as to have a thickness of 10 μm. Note that the thickness of the dielectric material layer 9 is not necessarily 10 μm, but it may have any thickness within a range of 1 μm to 20 μm.

To form the PZT film by the hydrothermal method, First of all, as illustrated in FIG. 3(*a*), PZT crystalline nucleuses 9*a* are formed on the surface of the cylindrical base 8. To be more specific, the cylindrical base 8 of the latent image forming body 1 is soaked in a mixture aqueous solution containing $Pb(NO_3)_2$ of 0.2 mol/l, $ZrOCl_2$ of 0.2 mol/l, and KOH of 2.0 mol/l, and a hydrothermal treatment at 160° C. is applied to the surface of the cylindrical base 8 for 10 hours. As a result, PZT crystalline nucleuses 9*a* are formed.

Next, as illustrated in FIG. 3(*b*), a PZT film is formed as the dielectric material layer 9. To be more specific, so as to grow the crystals, the latent image forming body 1 on which the crystalline nucleuses 9*a* are formed is soaked in a mixture aqueous solution containing $Pb(NO_3)_2$ of 0.2 mol/l, $ZrOCl_2$ of 0.2 mol/l, $TiCl_4$ of 0.2 mol/l, and KOH of 2.0 mol/l, and a hydrothermal treatment at 120° C. is applied for 48 hours. Thus, the PZT film is formed.

Thereafter, ultrasonic cleaning is applied to the latent image forming body 1 in an acetic acid aqueous solution, and dried. Then, a surface of the dielectric material layer 9 thus formed of the latent image forming body 1 is polished with a cerium oxide abrasive material whose particles have an average diameter of 1 μm each, so that its surface has a roughness (surface roughness) indicated by a center line average height (see JIS B0601 "Definition and Indication of surface roughness") of not greater than 0.2 μm.

Note that although in the present embodiment the surface of the dielectric material layer 9 is polished so as to have a surface roughness of 0.2 μm, another treatment may be applied. For example, as illustrated in an enlarged view of FIG. 1(*b*), a dielectric material 10 (dielectric material other than PZT) is applied to the surface of the dielectric material layer 9 and dried, so that a coating layer made of the dielectric material 10 is formed on the surface of the dielectric material layer 9. Not a specific material but any dielectric material can be used as the dielectric material 10. To give an example, polytetrafluoroethylene is used.

On the other hand, the write electrode 2 illustrated in FIG. 1(*a*), for forming electrostatic latent images of print patterns on the latent image forming body 1, is provided in contact with the surface of the latent image forming body 1. In the present embodiment, the write electrode 2 is a tungsten electrode. Since tungsten has wear and abrasion resistance, the write electrode 2 made of tungsten is long-lived.

Figure 4:
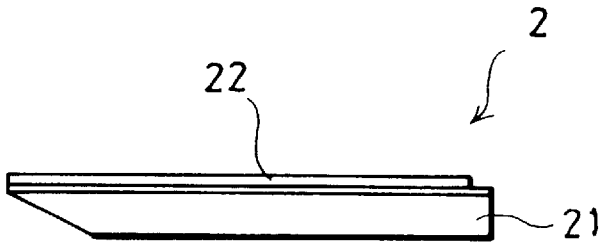
FIG. 4(*a*) is a perspective view illustrating a structure of a write electrode for the use in the foregoing printer.
Figure 4:
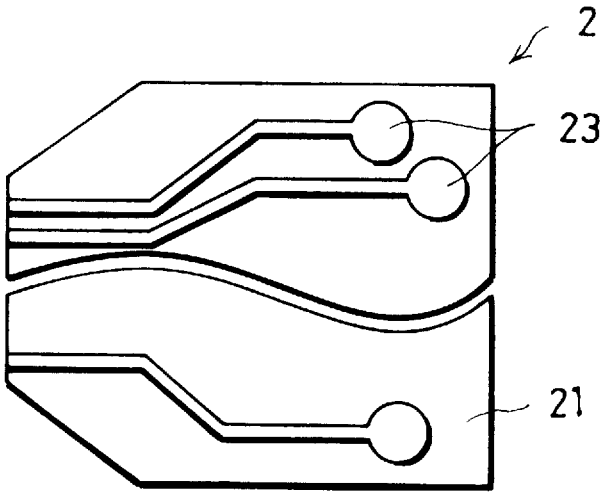

To be more specific, as illustrated in FIG. 4(*a*), the write electrode 2 is formed as follows: a tungsten foil 22 having a thickness of 18 μm is adhered onto a polyimide sheet (not shown), an etching is applied thereto so as to form a pattern, and it is provided on a head substrate 21 such as a glass epoxy substrate. Each electrode thus formed is connected to each electrode terminal 23 on a reverse surface of the head substrate 21, as illustrated in FIG. 4(*b*).

Here, in the present embodiment, it is possible to form metal electrode patterns 15 on the surface of the latent image forming body 1 so that each metal electrode pattern 15 corresponds to each of a plurality of recording pixels. With this arrangement, the contact between the write electrode 2 and the latent image forming body 1 is contact between metal electrodes and a metal surface. Therefore, electric charges are caused to smoothly move and spread, thereby causing a pixel region to remain unchanged. This causes write pixels to be evenly provided, as well as causes charges to be stably injected, thereby causing write voltages to be lowered.

On the other hand, as illustrated in FIG. 1(*a*), the development vessel 3 is provided on a downstream side with respect to the write electrode 2 (on a downstream side of a direction indicated by an arrow A). The development vessel 3 contains the liquid developer 11 as developer, and supplies the liquid developer 11, which is charged, to the latent image forming body 1, so that the liquid developer 11 adheres thereto so as to develop latent images.

Figure 6:
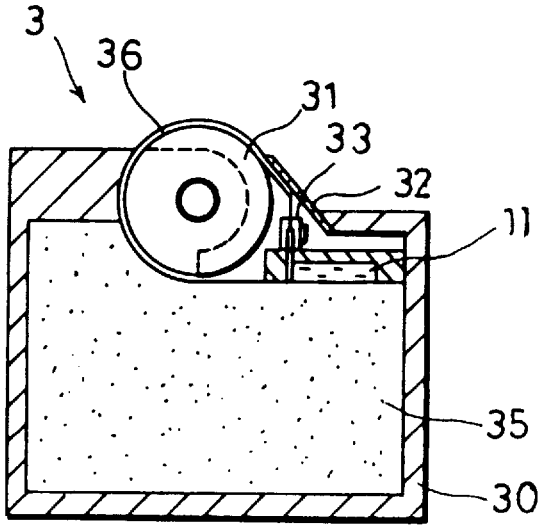
FIG. 6(*a*) is a cross-sectional view illustrating a structure of a development vessel for the use in the foregoing printer.
Figure 6:
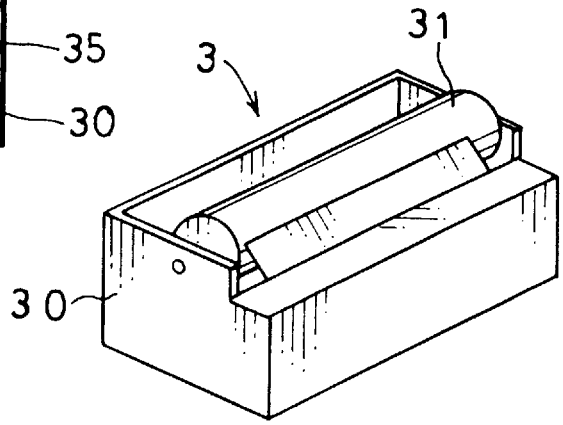

As illustrated in FIGS. 6(*a*) and 6(*b*), the development vessel 3 has a case 30, and there are provided a development roller 31, a blade 32, a spray nozzle 33, and others, in the upper part of the case 30. The liquid developer 11 is housed in the development vessel 3 in an impregnated state into a porous body. In the development vessel 3, the liquid developer 11 is sprayed with the spray nozzle 33 toward the blade 32, and the liquid developer 11 thus sprayed is guided by the blade 32 to the development roller 31 and forms a liquid developer layer 36 on the surface of the development roller 31.

Incidentally, the liquid developer 11 utilized as developer in the present embodiment is a colloidal matter, composed of, at least, an insulating solvent, coloring material particles, and a charge control agent. In the present embodiment, used as the liquid developer 11 is a colloid substance, which is formed by adding 10 g of carbon black whose particles have an average diameter of 0.2 μm each and a charge control agent into isoparaffin compound (trade name: isopar G11 produced by Esso Sekiyu K.K.) as an insulating solvent, so that the carbon black particles and the charge control agent are dispersed in the insulating solvent. Note that here colloid refers to a matter wherein fine particles having a diameter of not greater than around 0.5 μm each are dispersed in a solvent.

As the insulating solvent, not a specific insulating solvent but any one which is well known to the art may be adopted. More specifically, non-polar isoparaffin hydrocarbon series or other materials, for example, can be used. Among those on the market are, for example, isododecan (British Petroleum Co., p.l.c.), I. P. Solvent (Idemitsu Co.).

As the coloring material particles, carbon black, or the like, is used. As complementary color material for enhancing the degree of the black color of the coloring material particles, organic pigments, inorganic pigments, or the like, are used.

As the charge control agent, not a specific one but any one which is well known to the art may be adopted. More specifically, used as the charge control agent are, metallic salt, such as naphthenic acid, octyl acid, and stearin acid; ethylene diamine tetraacetic acid metallic complex salt; alkyl benzene calcium sulfonate, dioctyl calcium sulfonate, dioctyl sodium sulfonate, monolauryl phosphite acid zinc; β-alkyl alanine, linseed oil denaturated alkyd resin, fatviolet, methylene chloride copper phthalocyanine, polypropylene chloride, coumarone-indene resin, colophonium denaturated maleic resin, lecithin, nitrohumic acid, etc.

Figure 7:
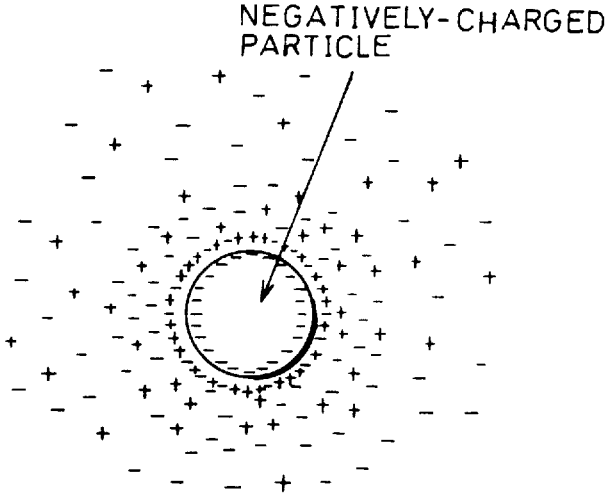
FIG. 7 is a view illustrating a charged state of a colloidal particle and an electrical distribution in the periphery thereof in a liquid developer for the use in the foregoing printer.

Moreover, the colloidal particles are charged to have the average quantity of charge in the range of $10^{-17}$ to $10^{-16}$ coulomb. As shown in FIG. 7, the colloidal particles are negatively charged in the insulating solvent, and dispersed due to repulsion that is exerted between them because of the charged state. Additionally solvent molecules in the proximity of the colloidal particles are positively charged.

The liquid developer 11 has the following features:

(1) There is no need of charging by the use of a charging device which is needed for a powdery developer.

(2) Its particle diameter is smaller than that of power in the order of one tenth; this makes it possible to provide high-definition images.

(3) It is possible to easily change the quantity of charge of the particles by adding a charge control agent there to; this makes it possible to increase the quantity of charge even in the case of developing low-voltage latent images.

Additionally, the reason that the present embodiment uses not a powdery developer but a liquid developer 11 is because the liquid is more easily handled in supplying, transporting, stirring, toner-density controlling, and other processes than the powder. Moreover, in recent years, various improvements have been made on ink-supplying devices for ink-jet recording apparatuses, and the liquid processes become rather easier than the powder processes. For example, since the liquid developer 11 is impregnated into the porous body 35, no spilling is caused even if it should be reversely placed; thus, ease of handling has been achieved.

As illustrated in FIG. 1(*a*), on a rotation direction side of the rotatable latent image forming body 1 (on a downstream side of a direction indicated by arrow A) with respect to the development vessel 3, a heating device such as a heater is provided inside the latent image forming body 1, at a position which corresponds to a position at which images on the latent image forming body 1 are transferred onto the paper 7.

The heating device 4 causes repulsion of the liquid developer 11, which is adsorbed in a charged state to the surface of the latent image forming body 1, to have repulsion, by utilizing the pyroelectric effect of the PZT film constituting the dielectric material layer 9, so that the visual image formed by the liquid developer 11 to be transferred onto the paper 7.

The following description will discuss a method for forming images by using a printer having the above-mentioned arrangement.

As illustrated in FIG. 1(*a*), in a state where the dielectric material layer 9, which forms the surface of the latent image forming body 1, is in contact with the development vessel 3, writing is carried out in accordance with a print pattern with respect to the dielectric material layer 9 by the use of the write electrode 2 with a voltage of, for example, 40 V. The latent image forming body 1 rotates in a direction indicated by an arrow B at a peripheral velocity of, for example, 20 mm/sec.

By doing so, surface charge is generated in the dielectric material layer 9, and an electrostatic latent image in accordance with the print pattern is formed on the latent image forming 1. At a position of the development vessel 3, the surface charge appearing on the latent image forming body 1 has an effect of attracting the charged coloring material particles (not shown) in the liquid developer 11. Thus, due to the surface charge appearing on the latent image forming body 1, the charged coloring material particles, which are subjected to electrophoretic force in the solvent, are adsorbed to the surface of the latent image forming body 1, thereby resulting in that the electrostatic latent image is developed. After the development, the latent image forming body 1 further rotates, and the visual image thus obtained by the development on the surface of the latent image forming body 1 is transferred onto the paper 7 which is being transported by the transport roller 5, immediately when the visual image arrives at an area where the latent image forming body 1 and the paper 7 come into contact.

Thus, in the printer of the present embodiment, writing is carried out by the use of the write electrode 2 in accordance with the print pattern with respect to the dielectric material layer 9 composed of the PZT film provided on the latent image forming body 1, in an area where the dielectric material layer 9 and the write electrode 2 come into contact.

By doing so, the surface charge, which is generated in the dielectric material layer 9 and causes the electrostatic latent image to be formed in accordance with the print pattern on the surface of the latent image forming body 1, has an effect of attracting the charged coloring material particles in the liquid developer 11. Therefore, the surface charge causes the coloring material particles to adhere to the surface of the latent image forming body 1, thereby developing the electrostatic latent image on the latent image forming body 1. On transferring the image thus developed onto the paper 7, heat is applied thereto by the heating device 4, thereby causing a spontaneous polarization value to decrease. As a result, the surface of the latent image forming body 1 is partially biased so as to have a reverse polarity. As a result, repulsion from the surface of the latent image forming body 1 occurs to the charged liquid developer 11 which has adhered to the surface. Thus, the transfer onto the paper 7 is carried out. As a result, a high-definition image formed with pixels which are $10^{-8}$ $m^2$ large each and are provided at a density of 300 DPI (Dot Per Inch) is obtained.

Incidentally, in the present embodiment, the dielectric material layer 9 is composed of a PZT film formed through crystal growth by the hydrothermal method.

The PZT film formed through crystal growth by the hydrothermal method differs in crystalline structure from PZT films formed by, for example, the sputtering method, the CVD method, or the sol-gel method, or bulk ceramics PZT (PZT as sintered body in a lump form), due to differences in producing processes, and the PZT film formed through crystal growth by the hydrothermal method has a uniform polarization direction. Therefore, the PZT film formed through crystal growth by the hydrothermal method has excellent pyroelectric characteristics. For this reason, the image forming apparatus is capable of writing with a low voltage, thereby having a smaller-size write electrode (write head) and a driving circuit produced at a lower cost.

Furthermore, the PZT film has a relative dielectric constant $\epsilon_r$ of, for example, 300 to 1000, which is rather high. Since the relative dielectric constant of the PZT film is incomparably greater than that of a conventional dielectric material layer made of zinc oxide, in the order of nearly 100 times, the quantity of the surface charge on the dielectric material layer 9 is extremely great in the case where the dielectric material layer 9 is composed of the PZT film. Therefore, in the case where writing is carried out with the same voltage, a quantity of electric charge accumulated in the dielectric material layer 9 thus formed is much greater than that in the conventional one formed with zinc oxide, in the order of about 100 times. Thus, by the use of the PZT film, a higher development speed can be obtained during the development process with the use of the liquid developer 11 in a charged state, while high-density recording is enabled.

Additionally, according to the hydrothermal method, a film is formed by, for example, growing liquid phase crystals at a relatively low temperature of 120° C. to 200° C. and in a low atmospheric pressure of about 5 atm. Therefore, it is possible to form a film on a surface having a large size or a three-dimensional curved surface with a lower cost.

In contrast, in the case where the PZT film is formed by a conventional method, such as the sputtering method, the CVD method, or the sol-gel method, application of heat at or over 500° C. is required. Therefore, a vacuum chamber having a large capacity is necessitated in the case where the PZT film is formed on the surface of the latent image forming body 1 having a large size by the sputtering method or the CVD method, and this may lead to a rise in the production cost.

Therefore, by forming the PZT film by the hydrothermal method, the dielectric material layer 9 thus formed has a high relative dielectric constant, while a high temperature treatment is unnecessary during the film forming process and a vacuum chamber having a large capacity is not needed, either.

As a result, it is possible to provide at a low cost a printer having the latent image forming body 1 which enables development at a high density and lowers consumed energy.

In the present embodiment, the heating device 4 for transferring the developed image onto the paper 7 is installed inside the latent image forming body 1. The heating device 4 causes repulsion of the liquid developer 11 which is adsorbed onto the surface of the latent image forming body 1 in a charged state, due to the pyroelectric effect of the PZT film of the dielectric material layer 9, so that the image visualized by the liquid developer 11 (liquid developer image) is transferred onto the paper 7.

In other words, as the PZT film is heated, the spontaneous polarization value decreases, thereby resulting in that the surface of the latent image forming body 1 is partially biased so as to have a polarity reverse to that of the latent image. Therefore, repulsion from the surface of the latent image forming body 1 occurs to the liquid developer 11 which is adsorbed to the surface of the latent image forming body 1 in a charged state. This facilitates the transfer of the visual image onto the paper 7.

Besides, a charging device usually necessary for the transfer, which causes corona discharge from a reverse side of the paper 7 or the like, is unnecessary in this case. Therefore, the above-described arrangement makes it possible to make the apparatus compact and to reduce the production cost, while ensures that no ozone is generated. Moreover, since the write electrode 2 is made of tungsten which has abrasion resistance, it is ensured that the write electrode 2 is long-lived.

Figure 5:
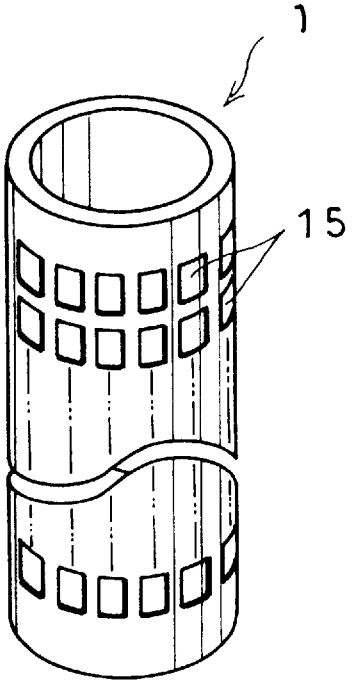
FIG. 5 is a perspective view illustrating a structure of the latent image forming body wherein metal electrode patterns are provided on the dielectric material layer.

Furthermore, it is possible to form metal electrode patterns 15 on the surface of the latent image forming body 1 so that each metal electrode pattern 15 corresponds to each of plural recording pixels as shown in FIG. 5. With this arrangement, contact between the write electrode 2 and the latent image forming body 1 is contact between metal electrodes and a metal surface, thereby causing the movement and dispersion of the electric charge. Therefore, the pixel region is fixed. As a result, the write pixels are evenly provided and the charge injection is stabilized, thereby ensuring that a voltage used for writing is reduced.

Incidentally, in the case where a PZT film is formed by the hydrothermal method, the surface of the film is normally uneven, with concave and convex portions having a height of 1 $\mu$m to 2 $\mu$m each in the case there the film is, for example, 20 $\mu$m thick. Therefore, in the case where the latent image forming body 1 having such an uneven surface is applied in the image formation operation, it may happen that small particles contained in the liquid developer 11, which are smaller than the concaves on the surface of the latent image forming body 1, get in the concaves and are not transferred onto the surface of the paper 7.

However, the dielectric material layer 9 of the present embodiment is polished, or coated with another dielectric material 10 so that the concaves have a height not greater than an average diameter of the particles contained in the liquid developer 11. By doing so, in the present embodiment, it is possible to prevent the particles (for example, carbon black) having an average diameter of, for example, 0.2 $\mu$m from getting caught in the concaves on the surface of the latent image forming body 1.

Therefore, the ratio of transfer from the dielectric material layer 9 of the latent image forming body 1 onto the paper 7 is enhanced, thereby resulting in that the picture quality obtained on the transfer-recording is improved. Besides, the abrasion of the write electrode 2 is lessen, thereby allowing the write electrode 2 to be long-lived.

To compare surface roughnesses of the dielectric material layers 9, a printing experiment was carried out using a latent image forming body 1 having a surface roughness of 0.7 $\mu$m, which was produced without a polishing process.

As a result of the experiment, the foregoing printer of the present embodiment exhibited a higher developing speed in comparison with a conventional printer or the like and a high recording density was obtained, although blanks occur as a printed amount increases, resulting in deterioration in the printing quality of the paper 7.

The cause of the blanks is that after the transfer of the coloring material particles therefrom, a part of the coloring material particles still are caught in the concaves on the surface of the latent image forming body 1, and the particles thus caught therein cannot be removed even by the cleaning blade (not shown). However, by manufacturing the printer of the present embodiment by applying the polishing treatment so that the dielectric material layer 9 thereof has a surface roughness of not more than 0.2 $\mu$m, the printer is capable of carry out the printing with less blanks even when the printed amount increases, thereby avoiding deterioration in the printing quality of the paper 7.

[Second Embodiment]

Figure 8:
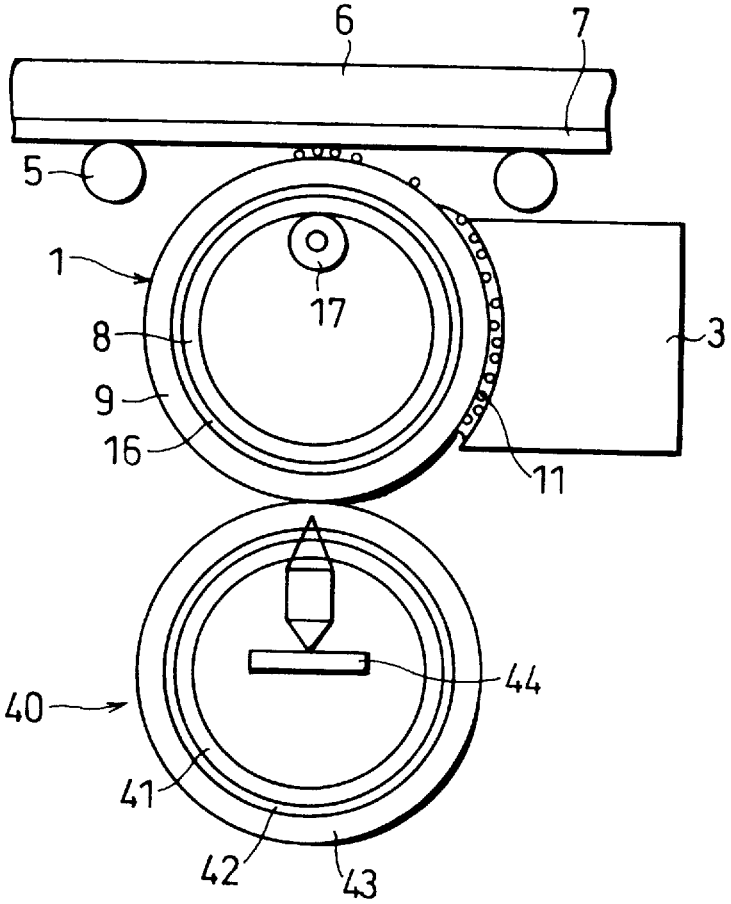
FIG. 8 is a view illustrating a schematic arrangement of a printer as an example of another image forming apparatus of the present invention.
Figure 9:
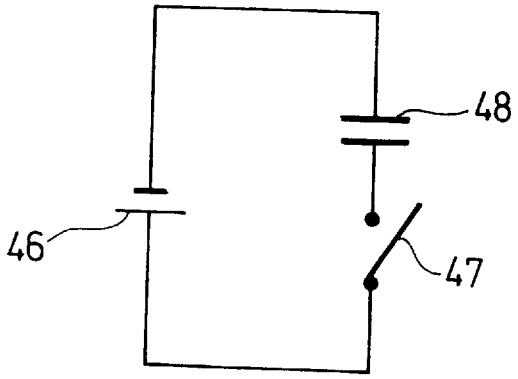
FIG. 9 is an equivalent circuit for illustrating a principle of information writing with respect to a latent image forming body by a photoconductive material drum in the foregoing printer.
Figure 10:
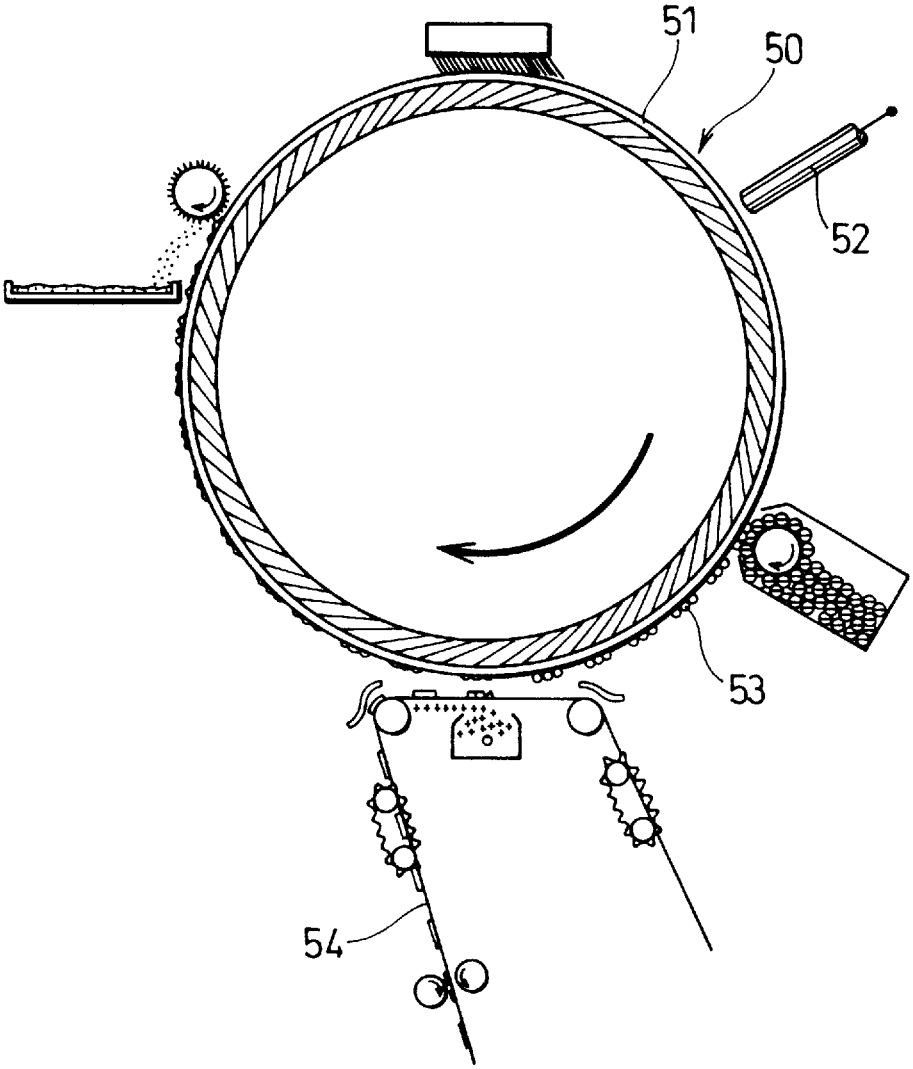
FIG. 10 is a schematic view illustrating an arrangement of a printer using a conventional image forming method.

The following description will discuss another embodiment of the present invention, while referring to FIGS. 8 and 9. The members having the same structure (function) as those in the above-mentioned embodiment will be designated by the same reference numerals and their description will be omitted.

A printer of the present embodiment has a write head which is rotatably provided and has a photoconductive layer on a surface thereof, as illustrated in FIG. 8. The photoconductive layer generates conductive carriers, upon receipt of information light from an information light source.

To be more specific, a photoconductive material drum 40 is provided as the write head, which is composed of a cylindrical glass tube 41 as a transparent substrate, ITO (Indium Tin Oxide) layer 42 as a transparent electrode, and a polycrystalline silicon layer 43 as a photoconductive layer. ITO is deposited on a circumferential surface of the cylindrical glass tube 41 so as to form the ITO layer 42, and the polycrystalline silicon layer 43 is provided on the ITO layer 42 by the CVD method so as to have a thickness of, for example, 5 $\mu$m.

Inside the photoconductive material drum 40, a light emitting diode (LED) array 44 is provided as the information light source. A light is projected from the LED array 44 onto the polycrystalline silicon film 43 in accordance with information such as printing signals.

Note that instead of the LED array 44, a common light source and a liquid crystal shutter array may be used.

On the other hand, a latent image forming body 1 of the present embodiment has a metal electrode 16 under the dielectric material layer 9, that is, between the cylindrical base 8 and the dielectric material layer 9.

Therefore, in the case where the dielectric material layer 9 of the latent image forming body 1 and the polycrystalline silicon film 43 of the photoconductive material drum 40 come into contact, the metal electrode 16 of the latent image forming body 1 and the polycrystalline silicon film 43 of the photoconductive material drum 40 constitutes a charging circuit through the dielectric material layer 9 of the latent image forming body 1. With this arrangement, it is possible to more efficiently inject charge, thereby enabling to more efficiently carry out the information writing.

In the write head thus arranged, an information light emitted by the LED array 44 installed in the photoconductive material drum 40 is transmitted through the cylindrical glass tube 41 and the ITO film 42 and is projected onto the polycrystalline silicon film 43. This causes conductive carriers to be generated in the polycrystalline silicon film 43.

Here, the light projection is carried out so that the information light can reach a region where the photoconductive material drum 40 and the latent image forming body 1 come into contact. Therefore, the conductive carriers generated in the polycrystalline silicon film 43 move to a surface thereof. On the other hand, a positive voltage is applied to the ITO film 42 of the photoconductive material drum 40, while the metal electrode 16 of the latent image forming body 1 has a ground potential. Therefore, the dielectric material layer 9 of the latent image forming body 1 is charged with injection of charge, thereby resulting in that a latent charge image is formed.

An equivalent circuit of the above-mentioned charging circuit is as illustrated in FIG. 9. A voltage power source 46, a switch 47, and a capacitor 48 of the equivalent circuit are equivalent to the ITO film 42, the polycrystalline silicon film 43, and the dielectric material layer 9, respectively. Thus, in the present embodiment, the writing with respect to the latent image forming body 1 is carried out by the photoconductive material drum 40 as the write head.

Note that although the heating device 4 composed of a heater is used as the heating means in the first embodiment, a heating device 17 of the present embodiment has a roller shape as illustrated in FIG. 8. The heating device 17 is rotatably provided in contact with an inner surface of the latent image forming body 1, with a temperature of the surface thereof being kept at, for example, about 80° C. A method for applying heat by converging a light of a xenon lamp may be applicable, but in this case it is preferable that the cylindrical base 8 is made of a transparent material such as glass.

Thus, the printer of the present embodiment is characterized in that the dielectric material layer 9 is composed of a PZT (lead titanate zirconate) film which is manufactured through crystal growth by the hydrothermal method, and that the write head is the photoconductive material drum 40 provided in a rotatable body which has, on the surface thereof, the polycrystalline silicon film 43 for generating conductive carriers upon receipt of the information light from the LED array 44.

Therefore, the contact movement of the photoconductive material drum 40 and the latent image forming body 1 is not slide but rotational contact, and this drastically lowers the abrasion of the photoconductive material drum 40, thereby ensuring that the photoconductive material drum 40 to be long-lived.

Furthermore, in the present embodiment, the photoconductive material drum 40 is composed of the cylindrical glass tube 41, the ITO film 42, and polycrystalline silicon film 43 which are laminated in this order, and the LED array 44 is provided inside the photoconductive material drum 40. In addition, the latent image forming body 1 has the metal electrode 16 under the dielectric material layer 9, and the ITO film 42 of the photoconductive material drum 40 and the metal electrode 16 of the latent image forming body 1 constitute a charging circuit through the dielectric material layer 9 of the latent image forming body 1.

With the above-described arrangement, the information light emitted from the LED array 44 provided inside the photoconductive material drum 40 is transmitted through the cylindrical glass tube 41 and the ITO film 42 and is projected onto the polycrystalline silicon film 43. With the projection of the information light, the conductive carriers are generated in the polycrystalline silicon film 43. Here, when a positive voltage is applied to the ITO film 42 of the photoconductive material drum 40 while the metal electrode 16 of the latent image forming body 1 is caused to have a ground potential, the dielectric material layer 9 is charged, thereby causing a latent charge image to be formed. As a result, the information to be recorded can be efficiently written to the dielectric material layer 9.

Furthermore, the information light of the LED array 44 is projected onto a region where the photoconductive material drum 40 and the latent image forming body 1 come into contact.

Therefore, the conductive carriers generated in the polycrystalline silicon film 43 move to the surface of the polycrystalline silicon film 43, thereby resulting in that the information to be recorded can be efficiently written to the latent image forming body 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a latent image forming body having a dielectric material layer on a surface thereof, the dielectric material layer being composed of a lead titanate zirconate (PZT) film formed through crystal growth in a liquid phase by the hydrothermal method and where the polarization direction of the PZT film is uniform;

image writing means, provided in contact with said latent image forming body, for forming an electrostatic latent image by conducting writing with respect to said latent image forming body in accordance with a print pattern;

development means for developing the electrostatic latent image with the use of a charge developer; and transfer means for transferring the visual image obtained by said development means to a recording medium.

2. The image forming apparatus as set forth in claim 1, wherein the dielectric material layer has such a surface roughness that developer particles in the developer do not get caught in concaves.

3. The image forming apparatus as set forth in claim 1, wherein the dielectric material layer has a surface polished so as to have a surface roughness of not more than 0.2 $\mu$m.

4. The image forming apparatus as set forth in claim 1, wherein the dielectric material layer is covered with a coating layer made of another dielectric material, the coating layer having a surface roughness of not more than 0.2 $\mu$m.

5. The image forming apparatus as set forth in claim 1, wherein the dielectric material layer has a thickness of 1 $\mu$m to 20 $\mu$m.

6. The image forming apparatus as set forth in claim 1, wherein said transfer means applies heat and causes repulsion of the developer adsorbed in a charged state to the surface of the latent image forming body, by utilizing a pyroelectric effect of the PZT film of the dielectric material layer.

7. The image forming apparatus as set forth in claim 1, wherein said image writing means is tungsten electrodes.

8. The image forming apparatus as set forth in claim 1, wherein said latent image forming body has metal electrode patterns on a surface thereof, each metal electrode pattern corresponding to each of a plurality of recording pixels.

9. The image forming apparatus as set forth in claim 1, wherein the developer is a liquid developer containing coloring material particles and a charge control agent in an insulating solvent.

10. The image forming apparatus as set forth in claim 1, further comprising an information light source, wherein said image writing means is a rotatable body having a photoconductive layer on a surface thereof, the photoconductive layer generating conductive carriers upon receipt of an information light from the information light source.

11. The image forming apparatus as set forth in claim 10, wherein:

said information light source is provided inside the rotatable body, the rotatable body has a transparent base, a transparent electrode, and a photoconductive layer laminated in this order from the side of said information light source; and said latent image forming body has an electrode layer under the dielectric material layer, the transparent electrode layer of the rotatable body and the electrode layer of said latent image forming body constituting a charging circuit through the dielectric material layer of said latent image forming body.

12. The image forming apparatus as set forth in claim 1, wherein the dielectric material layer has a dielectric constant in a range of 300 to 1000.

13. A method for forming images with the use of an image forming apparatus including a latent image forming body having a PZT film formed on a surface of the same through crystal growth in a liquid phase by the hydrothermal method where the polarization direction of the PZT film is uniform, development means, image writing means provided on an upstream side with respect to the development means, and heating means provided inside the latent image forming body, said method comprising the steps of:

(a) forming an electrostatic latent image on the latent image forming body in accordance with a print pattern, by causing the image writing means to come into contact with the latent image forming body in a state where the PZT film is in contact with the development means;

(b) developing the electrostatic latent image, by causing the development means to supply charged developer so that the developer is adsorbed to the surface of the latent image forming body; and (c) transferring a visual image obtained through the development in said step (b) onto a recording medium, by causing repulsion of the developer due to a pyroelectric effect of the PZT film which is caused by heating the latent image forming body with the use of the heating means.

14. The method as set forth in claim 13, the image writing means is a tungsten electrode.

15. The method as set forth in claim 13, wherein the developer is a liquid developer including an insulating solvent, coloring material particles, and a charge control agent.

16. The method as set forth in claim 13, wherein:

a plurality of metal electrode patterns are provided on a surface of the PZT film so that the metal electrode patterns correspond to recording pixels, respectively; and the electrostatic latent image is formed by charge injection while the image writing means is caused to contact the PZT film surface so that the metal electrode patterns come into contact with the image writing means.

17. A method for forming images with the use of an image forming apparatus, the image forming apparatus including a latent image forming body, development means, image writing means provided on an upstream side with respect to the development means, heating means provided inside the latent image forming body, an information light provided inside the image writing means, the latent image forming body having a PZT film formed on a surface of the same through crystal growth in a liquid phase by the hydrothermal method where the polarization direction of the PZT film is uniform and an electrode layer under the PZT film, the image writing means having a transparent base, a transparent electrode layer and a photoconductive layer, which are provided in this order from the side of the information light, said method comprising the steps of:

(a) generating conductive carriers on the photoconductive layer by causing the image writing means to come into contact with the PZT film in a state where the PZT film is in contact with the development means while projecting the information light from the information light source to a region of the contact;

(b) forming an electrostatic latent image on the latent image forming body, by applying a voltage to the transparent electrode layer while causing the electrode layer of the latent image forming body to have a ground potential so that the PZT film is charged;

(c) developing the electrostatic latent image, by causing the development means to supply charged developer so that the developer is adsorbed to the surface of the latent image forming body; and (d) transferring a visual image obtained through the development in said step (c) onto a recording medium, by causing repulsion of the developer due to a pyroelectric effect of the PZT film which is caused by heating the latent image forming body with se of the heating means.

18. The method as set forth in claim 17, wherein the developer is a liquid developer including an insulating solvent, coloring material particles, and a charge control agent.

* * * * *